United States Patent [19]

Yamada et al.

[11] 4,357,982

[45] Nov. 9, 1982

[54] APPARATUS FOR OPENING AND CLOSING HATCH COVER

[75] Inventors: Kikuo Yamada, Yamato; Kiyoshi Onodera, Yokohama, both of Japan

[73] Assignee: MacGregor International S.A., Switzerland

[21] Appl. No.: 299,861

[22] Filed: Sep. 3, 1981

[30] Foreign Application Priority Data

Sep. 12, 1980 [JP] Japan ..... 55-125911

[51] Int. Cl.[3] ..... E05F 11/00

[52] U.S. Cl. ..... 160/188; 114/201 R

[58] Field of Search ..... 160/188; 114/201, 202

[56] References Cited

U.S. PATENT DOCUMENTS

| | | | |
|---|---|---|---|
| 3,107,722 | 10/1963 | Larssen | 160/188 |
| 3,448,785 | 6/1969 | Hover et al. | 160/188 |
| 3,494,406 | 2/1970 | Roodenburg et al. | 160/188 |
| 3,811,396 | 5/1974 | Wessel et al. | 114/201 R |
| 4,193,439 | 3/1980 | Kummerman | 160/188 |

FOREIGN PATENT DOCUMENTS

| | | | |
|---|---|---|---|
| 1456289 | 12/1968 | Fed. Rep. of Germany | 114/202 |
| 52-25395 | 2/1977 | Japan | 114/202 |

*Primary Examiner*—Peter M. Caun

*Attorney, Agent, or Firm*—Steinberg & Raskin

[57] ABSTRACT

An apparatus for operating a hatch cover consisting of at least three pivotally interconnected cover sections foldable vertically accordionwise in a storage space adjacent to one hatch end, with the first lower section pivoted to said hatch end and the last cover section being connected to endless chain means extending along the hatch coaming and selectively engageable with drive means for pulling the hatch cover from open to closing position, said apparatus comprising telescopically extendable and retractable pivot arm means pivoted to said hatch end swingable between an upward vertical position and a downward horizontal position on a level below stud means projecting sidewise from each cover section, whereby said pivot arm means is selectively extendable for engagement with stud means of the cover section nearest to said hatch end.

3 Claims, 7 Drawing Figures

APPARATUS FOR OPENING AND CLOSING HATCH COVER

The present invention relates to an apparatus for opening and closing hatch covers, more particularly an apparatus for opening and closing hatch covers of accordion type consisting of at least three cover panels folded together in accordion shape at the storage station.

In prior art hatch covers of accordion type consisting of a number of panels, torsion bars or hydraulic actuating means are often provided internally of cover panels adjacent to particular articulated joints so as to have all the panels folded together automatically. However pipings and fittings within cover panels become complicated and expensive. When hydraulic actuating means are provided externally of cover panels, all the mechanism becomes more complicated as more cover panels are involved. A great deal of guide rails and accelerating ramps are required, thus increasing the manufacturing costs and rendering the maintenance difficult and troublesome. The present invention is aiming at solving various problems of this kind occuring in the prior art apparatus for opening and closing hatch covers of accordion type.

The object of the present invention is to provide an apparatus for opening and closing hatch covers of accordion type in which the number and kinds of construction parts are substantially reduced thus rendering the whole construction simple and less expensive.

According to the present invention, there is provided an apparatus for opening and closing hatch covers of accordion type consisting of at least three cover panels having each one end edge portions hingedly connected to those of adjacent cover panels and adapted to be folded together in accordion shape at a storage station with that so-called first cover panel, which is located nearest to the storage station in closed condition of the hatch, being provided with arm members pivotally connected each one to the storage station, and comprising a pivot arm having one end pivotally mounted on a support table adjacent to the storage station and adapted to be swung reciprocatingly between a horizontal stand-by position below horizontal studs provided on at least one side surface of the cover panels of odd numbers counted from said first panel and a vertical tilting position in which the pivot arm will tilt each panel of odd number into vertical position, means for actuating said pivot arm, such as hydraulic jacks, provided on the deck adjacent to said support table and having an operating end thereof connected to said pivotal arm, and driving means, such as endless chain, means connected to a last cover panel remotest from the first panel and causing said last panel to be reciprocated between a hatch closing position and a storage position, said apparatus being characterized in that said pivot arm has a telescopic construction so as to permit its length from one end thereof connected to said support table to its opposite end to be selectively varied.

In order that the invention may be more readily understood, and further features thereof may be appreciated, the invention will now be described by way of non-limiting example only with reference to the accompanying drawings, wherein.

Figure 1:
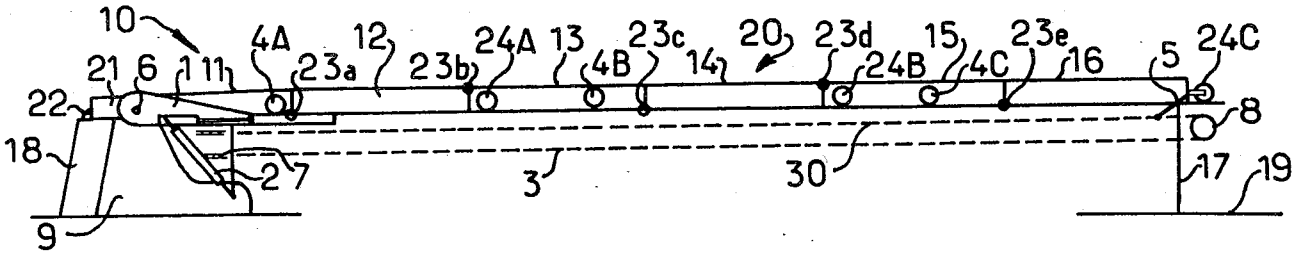
FIG. 1 is a side elevation view showing the hatch cover provided with the apparatus according to the present invention.

Referring to FIG. 1, there are shown to hatch cover 20 of accordion type consisting of a plurality of (for instance six as shown in the drawing) cover panels 11, 12, 13, 14, 15 and 16 laid over the hatch coaming 17 and the apparatus 10 according to the present invention. Each one of the cover panels 11, 12, 13, 14 and 15 is connected to adjoining panels, respectively, by means of hinge fittings 23*a*, 23*b*, 23*c*, 23*d* and 23*e*. The storage station 18 is located adjacent to the left end of the hatch coaming 17. In the hatch closing position of cover panels as shown in FIG. 1, the cover panel 11 (referred to as "first panel" hereinafter) nearest to the storage station 18 is provided at the left end thereof with at least one arm member 21, which is pivotally mounted at one end thereof on the storage station 18 by means of a pivot pin 22. Hence, the first panel 11 can be pivoted counterclockwise about the pivot pin 22 from the horizontal position as shown in FIG. 1 to the vertical stored position. Each one of the cover panels 11, 13 and 15 of odd number counted rightward from the first panel 11 is provided respectively with a horizontal stud 4A, 4B and 4C, each one of which is projecting outwardly from at least one side edge of each panel. The last panel, that is, the sixth panel 16 is provided with a connector fitting 5 which is depending from at least one side edge of that panel. If necessary, each one of the horizontal studs 4A, 4B, 4C may be provided respectively with a suitable concentric roller. The third panel 13, fifth panel 15 and sixth panel 16 are provided respectively each one with a wheel 24A, 24B and 24C, all of which will run along a guide rail (not shown) provided on the hatch coaming 17.

The apparatus 10 according to the present invention comprises a pivot arm 1 having one end pivotally mounted on a support table 9 by means of a horizontal pin 6, which support table 9 is located on deck 19 adjacent to the storage station 18.

Figure 3:
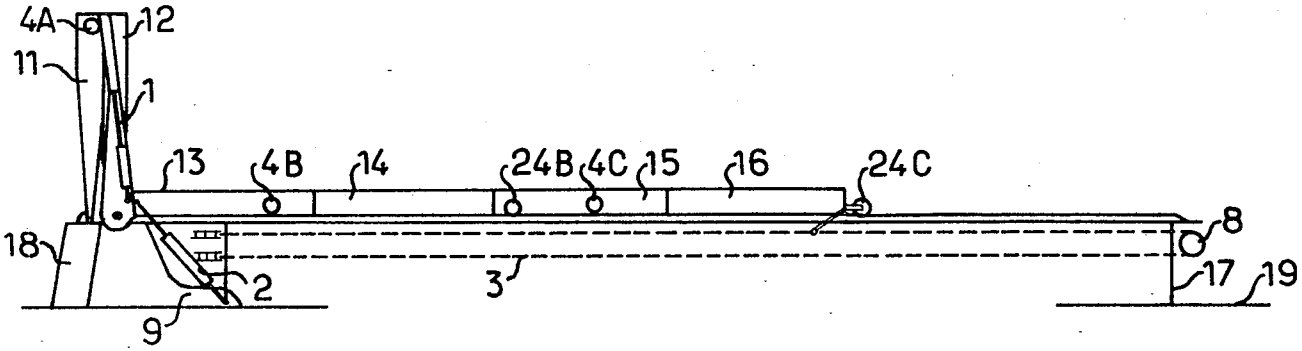
FIG. 3 is a side elevation view showing the first stage of operation of the apparatus in FIG. 1.
Figure 2:
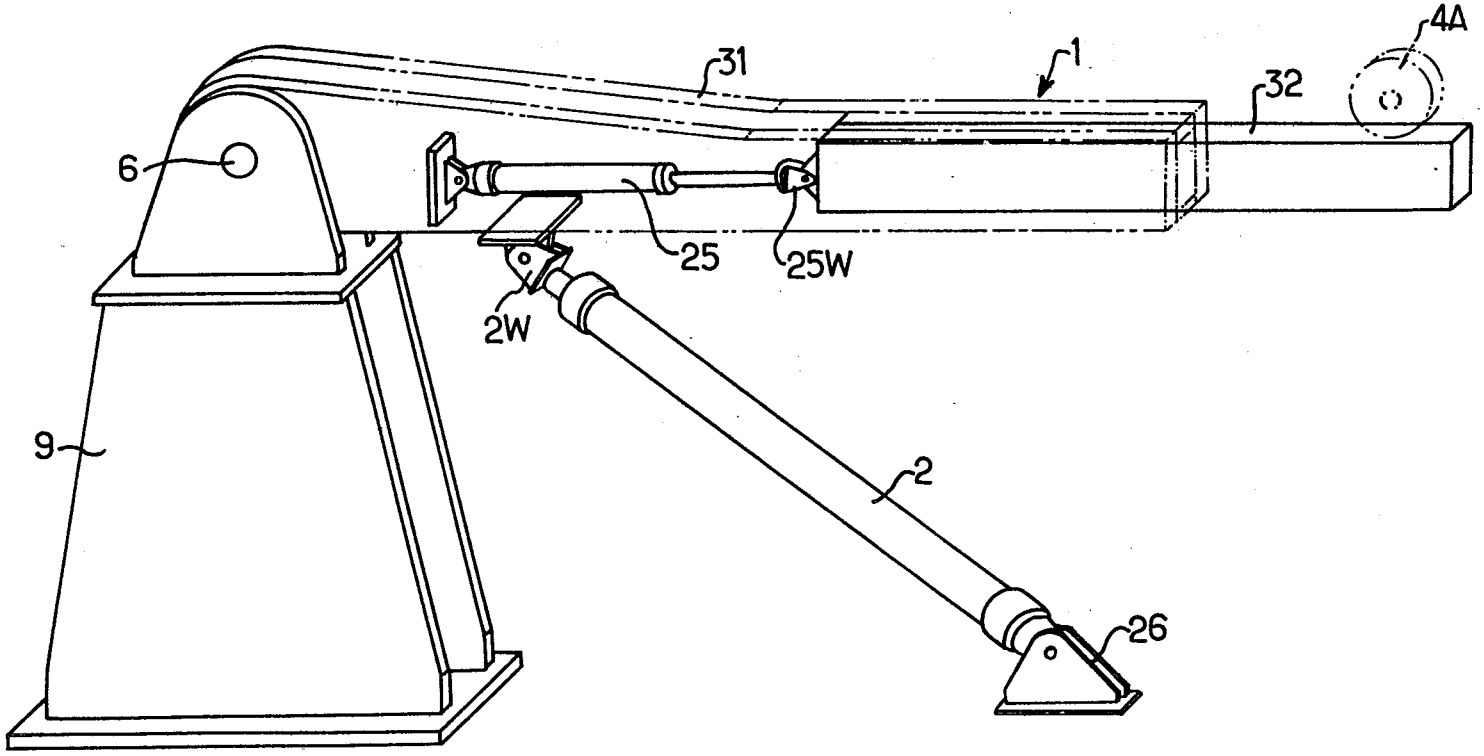
FIG. 2 is a perspective view on an enlarged scale showing an essential part of the apparatus according to the present invention.
Figure 5:
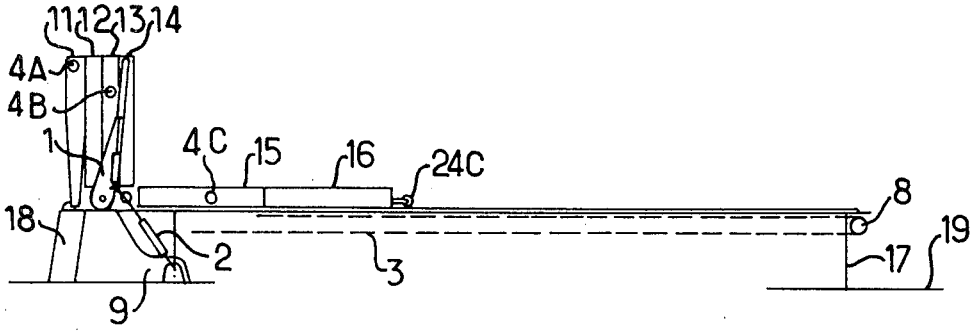
FIG. 5 is a side elevation view showing the second stage of the operation of the apparatus in FIG. 1.
Figure 7:
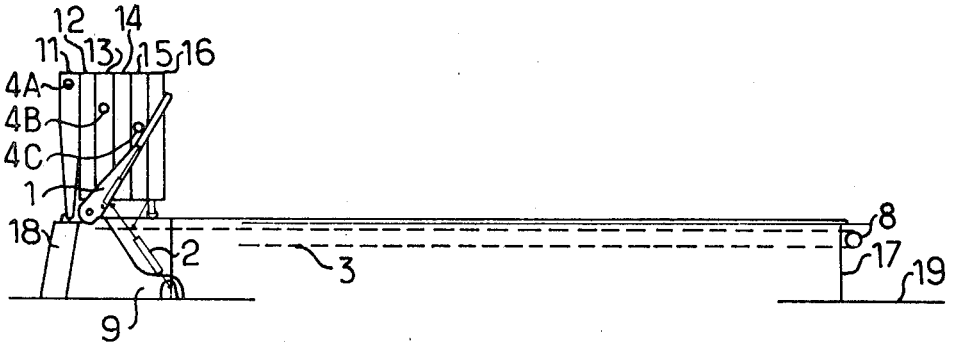
FIG. 7 is a side elevation view showing the last stage of the operation of apparatus in FIG. 1.

As shown in FIG. 2, the pivot arm 1 consists of a tubular member 31 having a left end thereof pivotally mounted on the support table 9 by means of the horizontal pin 6 and a sliding member 32 of telescopic construction inserted slidably into the tubular member 31 from the right end thereof. Means for actuating the telescope, such as a hydraulic cylinder 25, is provided within the tubular member 31 adjacent to the left end thereof. An actuating end 25W of the hydraulic cylinder 25 is connected to the sliding member 32. Therefore, the sliding member 32 will slide along the tubular member 31 by the action of the hydraulic cylinder 25 so as to have the distance between the horizontal pin 6 and the right end of the sliding member 32 adjusted as desired. A hydraulic jack 2 having one end pivotally mounted on a bracket 26 on the deck 19 is connected at the other end, that is, with its actuating end 2W to the tubular member 31 of the pivot arm 1. Accordingly, the pivot arm 1 will be reciprocatingly swung by the action of the hydraulic jack 2 between a horizontal position shown in FIGS. 1 and 2 and a vertical position shown in FIG. 3. More particularly, the vertical position of the horizontal pin 6 is selected such that the pivotal arm 1 in the horizontal position will extend from the horizontal pin 6 toward the hatch coaming 17 on a level below the horizontal studs 4A, 4B and 4C. The horizontal position of the pivotal arm 1 is a stand-by position in which the pivot arm 1 of telescopic construction is elongated on a level below the horizontal studs 4A, 4B and 4C. The vertical position of the pivot arm 1 as shown in FIGS. 3, 5 and 7 is a position in which the pivot arm 1 will cause each one of the odd number panels 11, 13 and 15 to be pivoted from the horizontal position to the vertical storage position. The sliding member 32 of the pivotal arm 1 of telescopic construction is long enough to extend rightward beyond the horizontal studs 4A, 4B and 4C, respectively, of the odd number panels 11, 13 and 15 when the sliding member 32 is pushed forward to the right as shown in FIG. 2 by the action of the hydraulic cylinder 25.

Returning to FIG. 1, on at least one side of the hatch coaming an endless chain 3 is entrained over a pair of sprockets 7 and 8 located at both ends of the hatch coaming 17. Either one of both sprockets 7 and 8 is connected to a suitable actuating power means (not shown). The actuating means is of reversible type. Suitable ratchet means and locking means are provided between the output or drive shaft of the actuating means and the sprocket 7 or 8 mounted thereon. Also, necessary guide sprockets and slack take-up sprockets (not shown) may be provided for the endless chain. The upper run 3U of the endless chain 3 is located oppositely to the lower surface of each one of panels 11–16 and is connected to the connector fitting 5 depending from the last cover panel 16. Accordingly, the sixth panel 16 will be moved together with other panels along the guide rail on the hatch coaming 17 by the operation of the endless chain 3.

In operation for opening the cover panels from the hatch closing position as shown in FIG. 1, the pivot arm 1 is horizontal stand-by position will have the sliding member 32 pushed forward sufficiently to the right to be placed below the horizontal stud 4A of the first panel 11. Then, when the pivot arm 1 is pivoted counterclockwise (FIG. 1) about the horizontal pin 6 by the action of the hydraulic cylinder 2, the pivot arm 1 will cause the first panel 11 to be pivoted counterclockwise about the pivot pin 22, thus bringing the first panel 11 into vertical storage position through a single operation. At this time, the second panel 12 is folded upon the first panel 11, and the remaining panels 12–16 are drawn toward the storage station 18 as shown in FIG. 3. At this time, the connector fitting 5 depending from the last panel 16 will draw the upper run 3U of the endless chain 3 leftward. The movement of the upper run 3U to the left is carried out without any difficulty, since a suitable ratchet gear is provided on the driving sprocket 8.

Figure 4:
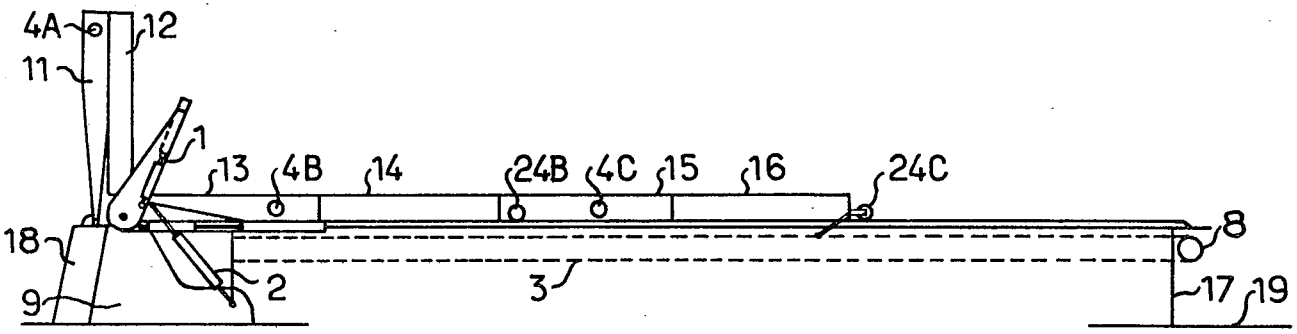
FIG. 4 is a side elevation view showing the stand-by position for the second stage of operation of the apparatus in FIG. 1.

After the first and second panels 11, 12 have been erected to the storage position, the actuating cylinder 25 for actuating the telescopic construction 32 is operated so as to retract the sliding member 32 within the tubular member 31 of the pivot arm 1 thereby reducing the length of the pivot arm 1 as shown in FIG. 4. Then, the pivot arm 1 will be brought back to the horizontal position without being fouled by the horizontal stud 4B of the third panel 13, which is located in the position adjacent to the storage station as shown in FIG. 4. At this time, each panel will not be brought back to the hatch closing position, since the sixth panel 16 is held firmly in the position shown in FIG. 4 by the endless chain 3. Then, the actuating cylinder 25 for actuating the telescopic construction is operated again so as to increase the length of the pivot arm 1 and place the projecting end 32 thereof below the horizontal stud 4B. Thereafter the hydraulic jack 2 is operated to swing the pivot arm 1 counterclockwise about the horizontal pin 6, thereby bringing the third panel 13 into the vertical storage position through a single motion as shown in FIG. 5. At this time, the fourth panel 14 is folded upon the third panel 13 with the following panels 15, 16 being drawn to the position adjacent to the storage station 18.

Figure 6:
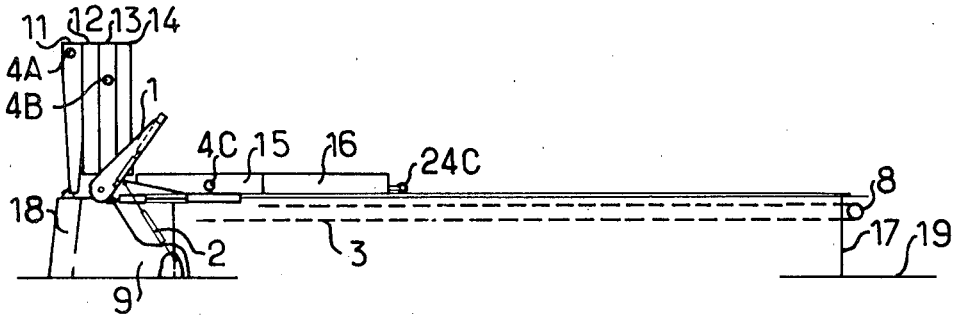
FIG. 6 is a side elevation view showing the stand-by position for the third stage of the operation of apparatus in FIG. 1.

Then, after having reduced the length of pivot arm 1 by the action of the actuating cylinder 25 on the telescopic construction as shown in FIG. 6, the pivot arm 1 is brought back to the horizontal position. Again, the length of the pivot arm 1 is increased by the action of the actuating cylinder 25 with the projecting end 32 of the pivot arm 1 placed below the horizontal stud 4C of the fifth panel 15. Then, the hydraulic jack 2 is operated so as to swing the pivot arm 1 counterclockwise or upwards, about the horizontal stud 6, thereby bringing the fifth panel 15 through a single motion into the vertical storage position with the sixth panel 16 folded upon the fifth panel 15, thus completing the storage of all panels as shown in FIG. 7. As stated hereinabove, all of the six panels are brought into storage position by repeating three times the erecting operation as shown in FIG. 3. Of course, the present invention can be applied to a hatch cover having an odd number of panels.

In case of bringing all the cover panels into hatch closing position from the storage position, all the panels 11–16 are hauled along the hatch coaming 17 in the reverse order with respect to that described hereinabove by the action of the endless chain 3. That is, the sixth and fifth panels 16, 15 are first hauled from the storage station onto the hatch coaming 17 by the action of the endless chain 3 as shown in FIG. 7. During the hauling operation, the pivot arm 1 will pivot clockwise about the pin 6 slowly with the upper surface thereof engaged with the horizontal stud 4C of the fifth panel 15, thus preventing both panels 15, 16 from a violent fall or descent. In a similar manner, the pivotal arm 1 is engaged with the horizontal stud 4B during the hauling motion of the fourth and third panels 14, 13 and engaged with the horizontal stud 4A during the hauling motion of the second and first panels 12, 11 and will pivot slowly while supporting the weight of the cover panels, whereby the cover panels are successively hauled with their falling speed suitably controlled.

As described hereinabove, the whole apparatus becomes extremely simplified, and comprises only one set of pivot arm 1 and endless chain 3 as a component thereof on each side, with any other parts eliminated. Accordingly, the kinds and number of parts are substantially reduced, thereby not only minimizing the construction cost, but also facilitating the operation and maintenance, thus substantially reducing the time and labour involved by the operation. Further according to the present invention, each panel is brought from the position over the hatch coaming to the storage position through a single motion without any panel being kept in any intermediate position, and hence it is possible to eliminate unstable positions, violent running and wrong handling of the cover panels. The advantages of the present invention also reside in that it is not necessary to stop or control the operation of each panel in view of the presence of horizontal studs 4A, 4B, 4C when bringing the pivot arm 1 back into horizontal position, and in that the hydraulic oil circuit is simplified for feeding the hydraulic jack 2 and the actuating cylinder 25 for operating the telescopic construction and in that the whole system is operated quietly and safely.

What is claimed is:

1. Apparatus for opening and closing hatch covers of accordion type consisting of at least three cover panels having each one end edge portion hingedly connected to those of adjacent cover panels and adapted to be folded together in accordion shape at a storage station with that so-called first cover panel which is located nearest to the storage station in closed condition of the hatch, being provided with arm members pivotally connected each one to the storage station, and comprising a pivot arm having one end pivotally mounted on a support table adjacent to the storage station and adapted to be swung reciprocatingly between a horizontal stand-by position below horizontal studs provided on at least one side surface of cover panels of odd numbers counted from said first panel and a vertical tilting position in which the pivot arm will tilt each panel of odd number into vertical position, means for actuating said pivot arm, such as hydraulic jacks, provided on the deck adjacent to said support table and having an operating end thereof connected to said pivot arm, and driving means, such as endless chain, means connected to a last cover panel remotest from the first panel and causing said last panel to be reciprocated between a hatch closing position and a storage position, said apparatus being characterized in that said pivot arm has a telescopic construction so as to permit its length from one end thereof connected to said support table to its opposite end to be selectively varied.

2. Apparatus according to claim 1, wherein each pivot arm is on the one hand extendable to a length engageable with a stud of any cover panel which is close to said storage station and on the other hand retractable to such a short length that it is not engageable with such a stud.

3. Apparatus according to claim 2, wherein said chain means extend along the hatch coaming and are connected to reversible drive means through selectively disengageable coupling means.

* * * * *